US006001219A

United States Patent [19]

Caspar

[11] Patent Number: 6,001,219

[45] Date of Patent: Dec. 14, 1999

[54] WATER JET EDGE TRIMMING STATION FOR USE IN PAPERMAKING MACHINE

[76] Inventor: Roman C. Caspar, 21 Margaret Ann, Beaconsfield, Quebec, Canada, H9W 5N7

[21] Appl. No.: 08/852,345

[22] Filed: May 7, 1997

[51] Int. Cl.[6] ..... B26D 5/12

[52] U.S. Cl. ..... 162/286; 162/310; 162/363; 83/177; 83/402

[58] Field of Search ..... 162/286, 194, 162/310, 363, 364, 195, 198; 83/177, 402, 53, 428

[56] References Cited

U.S. PATENT DOCUMENTS

| | | | |
|---|---|---|---|
| 2,667,106 | 1/1954 | Hyman et al. | 162/255 |
| 3,532,014 | 10/1970 | Franz | 83/53 |
| 3,556,936 | 1/1971 | Miyamoto | 162/272 |
| 3,682,750 | 8/1972 | Gerber | 156/545 |
| 3,927,591 | 12/1975 | Gerber | 161/68 |
| 3,996,825 | 12/1976 | Terry | 83/53 |
| 4,137,804 | 2/1979 | Gerber et al. | 83/177 |
| 4,182,170 | 1/1980 | Grupp | 73/177 |
| 4,266,112 | 5/1981 | Niedermeyer | 83/53 |
| 4,410,315 | 10/1983 | Frye | 493/342 |
| 4,567,796 | 2/1986 | Kloehn et al. | 83/53 |
| 4,827,679 | 5/1989 | Earle, III | 51/410 |
| 4,882,961 | 11/1989 | Zabinski et al. | 83/177 |
| 4,931,140 | 6/1990 | Peltola et al. | 162/193 |
| 5,068,513 | 11/1991 | Gangemi | 219/121.67 |
| 5,295,425 | 3/1994 | Hediger | 83/177 |
| 5,512,136 | 4/1996 | Altug et al. | 162/195 |
| 5,571,381 | 11/1996 | Vessari et al. | 162/195 |

FOREIGN PATENT DOCUMENTS

| | | |
|---|---|---|
| 772459 | 11/1967 | Canada . |
| 772461 | 11/1967 | Canada . |
| 3219564 | 12/1983 | Germany . |
| 4218272 | 10/1992 | Germany . |

*Primary Examiner*—Stanley S. Silverman
*Assistant Examiner*—Jose' A. Fortuna

[57] ABSTRACT

A water jet edge trimming station for trimming the edges of coated paper during on-machine operation includes backsplash compensating features. The edge trimming station has a cutting station over which the web travels to be cut. The water jet travels along a water jet axis to a point of impingement at the cutting station to cut the web. The cutting station has an effluent receiving aperture at the point of impingement. A negative pressure mixing zone located below the aperture draws effluent by-products or backsplash associated with cutting of the web below the cutting surface of the web. The water jet axis is offset a first predetermined angle chosen relative to a normal axis passing at right angles through the point of impingement to reduce backsplash. The water axis jet is rotated about the normal axis by a second predetermined angle to direct the effluent by-products away from the water jet nozzle and the traveling web. The water jet cutting apparatus has positive air pressure chamber surrounding the nozzle head of the water jet to maintain an air flow over the nozzle head driving effluent backsplash away from the nozzle head.

25 Claims, 5 Drawing Sheets

WATER JET EDGE TRIMMING STATION FOR USE IN PAPERMAKING MACHINE

FIELD OF THE INVENTION

The present invention is directed to a water jet edge trimming apparatus for trimming the edge from a moving web in a papermaking machine. More specifically, the present invention is directed to a water jet edge trimmer system for trimming coated paper.

BACKGROUND OF THE INVENTION

In the papermaking industry certain applications require edge trimming of the paper web during web travel in the papermaking machine. One such application occurs in the manufacture of coated paper. Coating can be done "on-machine" or "off-machine". Coating on-machine means that the paper is made in the normal fashion and an additional coating station is provided such that the paper is coated as it travels in the papermaking process.

During the coating process the "raw stock" paper is coated across the width of the web except for the edges of the paper where a trim of 0.5 to 3 inches of the paper web is not coated. Both sides of the paper web may be coated with plastic or paint products which can make up a significant part of the paper weight. The uncoated edges must be trimmed off before processing the paper further, such processing involving calendering or supercalendering, for example. This trimming step is typically done by means of a mating pair of rotary slitting knives. Slitting knives, or "slitters" are used to trim paper edges after the coating station thereby removing un-coated edges of the paper from the traveling web. Slitters are also employed upstream of the coating station to cut the paper web prior to coating preventing cracked edges from entering the coater because coating of cracked edges leads to further complications.

There are disadvantages associated with the use of knives. Knives require high maintenance due to abrasive wear of the coating filler material, i.e. calcium carbonate or titanium dioxide. Further, slitter knives have a tendency to separate (jamming) when flying splices of overlapping paper sections joined together by tape having triple the basis weight pass by the knife slitters. Jamming leads to paper breaks. Also, slitter knives are very sensitive to paper wrinkles that enter the slitting zone resulting in edge tearing of the paper. Further, it is very difficult to enter the running paper web into the paired slitter knives without crimping the edge which can lead to web breaking.

For the above stated reasons, it is standard practice in the paper making industry to avoid cutting the trim on the on-machine coater, because one paper break may cost up to $8000 in lost production time. To avoid the potential hazards associated with on-machine trimming, trimming is usually done off-machine on a re-reeler machine which is a separate machine used to un-reel, edge trim and re-reel the paper web. Such a re-reeler operation requires significant labour costs to operate in addition to the capital costs of purchasing such a machine. Clearly, on-machine trimming of the edge of the paper web during the coating section of the machine would be the preferred choice of manufacture if the risks associated with web breakage by edge trimming after the coating station could be avoided or reduced.

If a water jet could be used to trim the edge of the coated paper, then the disadvantages associated with the use of rotary knives in the on-machine edge trimming would be avoided. The pressure of the water jet is sufficient to cut through flying splices of triple basis weight on the coated paper. Further, changes in tension which can cause paper wrinkling have no apparent effect on the water jet cutting ability to provide a clean cut without tearing.

While it is known to use water jets to cut a paper web, the general teaching in the art is to cut the web with the water jet impinging the web surface in a direction normal to the web surface to maximize the cutting efficiency of the water-jet. However, when this teaching was applied by the applicant to coated paper webs, some disturbing problems were experienced which adversely affected the cutting performance of the water jet.

One problem experienced with using such a normal directed water jet to effect trimming of the coated paper is backsplash. It should be understood that the water jet pressure and nozzle orifice can be chosen such that the water jet impinges the paper web at speeds in excess of 2000 feet/second or about 615 meters/second. The energy of this impact transforms the fluid into a gaseous state. This represents expansion in volume in the order of 1250 times. Consequently the gas stream formed by the water jet impinging the web results in a cloud of fumes when the paper is of sufficient weight and thickness to backsplash minute portions of the water jet spray. The fumes and atomized paper particles backsplash towards the nozzle head of the water jet. The coating mass on the paper which contains calcium carbonate is splashed from the cutting surface back to the nozzle head and is also sprayed on other parts of the paper. During use, the fine particles of calcium lump together to form and build up extending down from the nozzle to the surface of the paper in a gummy "stalacite" type of deposit. Eventually this "stalactite" type of deposit breaks off in a lump and travels on the boundary layer of the good paper web to the wind up station where the lumped particles are glued to the next layer of paper. Upon un-winding, the glued together layers are ripped at the edge leading to complete web breaks across the paper web. Clearly, this will result in down time to re-splice and feed the tail of the paper web through the machine. Furthermore, splattering of the calcium deposits on the boundary edge of the coated paper deteriorates paper quality.

The use of water jets to perform slitting, tail cutting and trimming has been disclosed in the patent literature, but there is no disclosure as to how to use the water jets to cut an "unfriendly" paper web such as coated paper during on-machine operation. For example, U.S. Pat. No. 3,996,825 issued Dec. 14, 1976 to Rupert Terry discloses a water jet cutter for cutting and trimming a web. A first water jet impinges the web from below the web at a normal angle of 90° to the plane of the web. A second water jet impinges the web from above the web at the same point as the lower water jet impinges the web. The upper or second water jet is angled relative to the vertical axis or axis normal to the plane of the web to direct the second water jet towards the outside edge of the paper web such that the water jet forces the cut web edge away from the existing web to the outside of the cutting station. The patent teaches that various angles relative to the vertical can be used by the second water jet as long as the jet is emitted directly downwardly and toward the outside edge. A suitable angle is typically about 45 degrees. Such a trimmer would not work in cutting coated paper because splashing from each water jet onto the other water jet is subject to the problems associated with the above noted trimming of coated paper on-machine.

U.S. Pat. No. 5,068,513 issued Nov. 26, 1991 to Donald Gangemi teaches a water jet cutter that is used with a laser as a slitter. In one embodiment, the water jet cutter is angled rearwardly or upstream with respect to the direction of web travel. However, the patent teaches that the relative orientation of the water jet nozzle and the laser is not deemed to be of critical importance so long as the water jet nozzle and the laser are focused at the same general spot on the traveling web. Also, DE patent application 4,28,272 laid open Oct. 29, 1992 in the name of J. M. Voith GmbH discloses the use of either rotary cutters, water jets or lasers to cut a tail in a paper by angling the resultant cut with a vector component in opposing direction to the direction of web travel and in a second direction into the center of the web away from the edge of the web. Again these patents are not concerned with backsplash and would be subject to waste deposit build upon the nozzle heads and laser heads.

While prior art water jet cutters for use in tail cutting, slitting and to a lesser extent trimming are known in the paper making industry, none of these patents addresses the problems associated with backsplash and the effects of backsplash on clotting the nozzle and effecting paper quality as a result of cutting through coated paper on-machine. There is a need for a water jet edge trimming system which is not subject to the disadvantages associated with the knife edge trimmers of the prior art.

SUMMARY OF THE INVENTION

The present invention is directed to a water jet cutting apparatus that is not subject to the problems associated with backsplash while trimming the edges of paper on-machine. While the present invention finds particular advantage in cutting coated paper on-machine, aspects of the present invention may find application in cutting and trimming other grades of paper web including webs of considerably less basis weight such as tissue paper where rewetting and redepositing of fines during trimming can cause deposit problems.

In accordance with one aspect of the present invention a water jet edge trimming station is provided for trimming the edge of a traveling web in a papermaking machine. The edge trimming station has first novel aspects in the manner in which effluent by-products associated with cutting the web are drawn below the cutting surface of the web to reduce backsplash and the manner in which a cutting station is constructed to withstand wear associated with paper striking the cutting station.

In accordance with a second novel aspect of the present invention the water jet used to cut the paper is angled relative to the direction of paper web travel and the outside edge of the paper web travel. The angling of the water jet relative to the direction of paper web travel, and in particular the downstream direction, it is meant that the water jet may face downstream in the direction of web travel and the waterjet cuts at an impact angle which in theory is the same as the exiting angle, but in practice the exiting angle is slightly less than impact angle when the jet is facing downstream due to the downstream speed of the traveling web. The relative angling of the water jet is done with respect to a the vertical or normal axis passing through a plane of the web and the side edge of the web to reduce backsplash of effluent by-products onto the water jet nozzle.

In accordance with yet a third novel aspect of the present invention the construction of the water jet cutting apparatus of the present invention has positive air pressure chamber surrounding the nozzle head of the water jet to maintain air flow over the nozzle head acting to drive away effluent deposits adversely affecting nozzle head performance.

In accordance with the first broad aspect of the present invention there is provided a water jet edge trimming station for trimming an edge of a traveling web in a papermaking machine. The station includes a water jet apparatus supported above the web for directing a water jet towards a point of impingement against the web to cut through the web and form an edge trim piece separate from the web. The water jet forms effluent by-products as it cuts the web. The station includes a support table positioned below the water jet and over which at least an edge portion of the web travels. The support table includes a cutting station. The cutting station includes a hardened cutting surface to better withstand cutting and wearing associated with the paper striking the cutting surface. The cutting surface includes an effluent receiving aperture positioned directly below the point of impingement of the water jet through which passes the water jet after cutting through the web. The cutting station includes a negative pressure apparatus adapted to draw the water jet and the effluent by-products through the receiving aperture to accept the effluent by-products.

By using a negative pressure or vacuum to draw effluent by-products through the effluent receiving vacuum assisted aperture in the cutting station, the effluent by-products can be removed from the papermaking machine. Backsplash onto the traveling web and nozzle head is diminished resulting in improved continued water jet cutting performance and paper quality.

The hardened cutting surface preferably comprises a ceramic shoe mounted raised above the support table by about 1 to 4 mm. The effluent receiving aperture is located in the ceramic shoe. By raising the ceramic shoe or platform above the remainder of the cutting station, then only the ceramic shoe is exposed to wear. The use of a ceramic shoe improves longevity of the cutting station. Any suitable material can be used that can withstand the wear and cutting associated with the paper striking this surface and in particular over the vacuum assisted aperture. In the preferred embodiment, there is a cut out section on the bottom surface of the ceramic shoe adjacent the effluent receiving. The purpose of using a cut out section is to reduce the depth of the effluent receiving aperture and land area in the aperture struck by the water jet and paper so as to prevent buildup of effluents in the downstream land area of the aperture.

The cutting station preferably includes a draft tube extending from the effluent receiving aperture into the cutting station. The cutting station includes a chamber into which the draft tube partially extends to define an outer passage surrounding the draft tube. The chamber includes a water inlet and an air inlet adjacent the hardened cutting surface which permit the introduction of water and air into the outer passage surrounding the draft tube and extending into the cutting station. The cutting station further includes a mixing zone located below the draft tube and the outer passage for mixing the air and water from the outer passage and effluent by-products from the draft tube.

It is envisaged that the effluent receiving aperture is located a predetermined distance upstream of a downstream end of the cutting station so as to prevent buildup of effluent by-products on the hardened surface of the cutting station downstream of the effluent receiving aperture. By maintaining this distance relatively short, any effluent by-products that are not exhausted through the effluent receiving aperture have a relatively short area to buildup gummy deposits which could adhere to the hardened surface of the cutting station. In accordance with the present invention the predetermined distance is in the range of 5 to 50 mm and preferably about 40 mm.

In the preferred embodiment, the support table, on which the raised cutting station is mounted includes two platforms.

A first raised platform extends from the cutting station downstream for supporting the traveling web. A second platform stepped down relative to, or lower than, the first platform also extends from the cutting station downstream for supporting the edge trim piece separated from the web. By having the second platform positioned below the first raised platform, separation of the edge trim piece from the continuing traveling web is facilitated. Furthermore, in the preferred embodiment, an elongated slotted aperture is provided between the first and second platforms. The purpose of a slotted aperture is to provide an unsupported section in the web travel for the wet edges of the continuing traveling web and the traveling edge trim piece. It is believed that the open elongated slotted aperture allows the unsupported edges to dry and any effluent by-product carried by the wet edges does not find a surface against which effluent by-products can buildup ultimately effecting paper quality and the trimming function.

In accordance with a preferred aspect of the present invention, the trim chute is attached to the support table. It should be understood that in an alternative embodiment, the trim chute may be located further downstream separated from the support table. In such an embodiment, it is possible to separate the edge trim piece by means of air jets which also act to guide the edge trim piece to the destination trim chute.

In accordance with a second broad aspect of the present invention there is provided a water jet edge trimming station for trimming an edge of a web in a paper machine where the web traveling past the station is relatively flat defining a web plane. The water jet edge trimming station includes a water jet apparatus having a nozzle supported in spaced relation from the web plane for emitting a water jet along a water jet axis towards a point of impingement against the web to cut through the web and form an edge trim piece separate from the web. The water jet forms effluent by-products as the water jet cuts the web. The water jet axis has a first orientation offset by a first predetermined angle relative to a normal axis extending at a right angle out of the web plane from the point of impingement such that the first orientation of the water jet directs the waterjet in a first direction relative to web surface travel to reduce backsplash of effluent by-products onto the nozzle. The water jet axis has a second orientation rotated by a second predetermined angle about the normal axis from a line extending parallel to the direction of web travel passing through the point of impingement, whereby the water jet is directed towards the edge trim piece causing effluent by-products to move towards the edge trim piece and away from the web to reduce backsplash onto the nozzle and the web.

The first predetermined angle may be in the range of 15° to 45° and is preferably about 22° from the vertical.

The second predetermined angle may be in the range of 5° to 135°. The preferred range for the second predetermined angle is in the range of 5° to 89° and the water jet is directed generally in a downstream direction. The preferred second predetermined angle is about 30°. Alternatively, the range of the second predetermined angle is between 91° to 135° and the water jet is directed in an upstream direction. When directed in an upstream direction, the first predetermined angle is to be chosen to cause the effluent by-products to move laterally towards the edge of the web without being blown back by boundary layer windage associated with the traveling web.

It is further contemplated to position the nozzle of the water jet within a predetermined distance from the traveling web to maintain a laminar jet of water to cut the web. Preferably, this distance is about 12 mm from the web.

It is also contemplated to include in the water jet station an auxiliary air nozzle positioned immediately upstream and laterally from the water jet for directing an air stream down on an edge of the traveling web to move the edge trim piece away from the traveling web and to further direct effluent by-products away from the traveling web.

In accordance with a third broad aspect of the present invention there is provided a water jet apparatus for use in an edge trimming station for trimming an edge trim piece from a traveling web in a papermaking machine which produces effluent by-products during trimming. The water jet includes a water jet nozzle head having a water inlet tube and a nozzle having an outlet orifice through which a water jet is emitted. Additionally, an enlarged nozzle head housing is attached to the water jet nozzle head to define a chamber surrounding at least a portion of the water jet nozzle head. The enlarged nozzle head housing has a front surface spaced from and surrounding the nozzle to define an air outlet passage around the nozzle. The enlarged nozzle head housing includes an air inlet through which pressurized air enters the chamber and flows towards and out of the air outlet passage to counteract backsplash of the effluent by-products.

The enlarged nozzle head housing is preferably curved to guide the traveling web under the front surface to the water jet emitted from the outlet orifice. Additionally, an auxiliary air nozzle can extend around the outer surface of the front surface to direct an air stream across the web to the outside of the web direct effluent by-products away from the nozzle head and traveling web towards the edge trimmed. Preferably, the outlet orifice extends forward of the front surface of the enlarged nozzle head housing.

BRIEF DESCRIPTION OF THE DRAWINGS

For a better understanding of the nature and objects of the present invention reference may be had to the accompanying diagrammatic drawings in which.

DETAILED DESCRIPTION OF EMBODIMENTS

Figure 1:
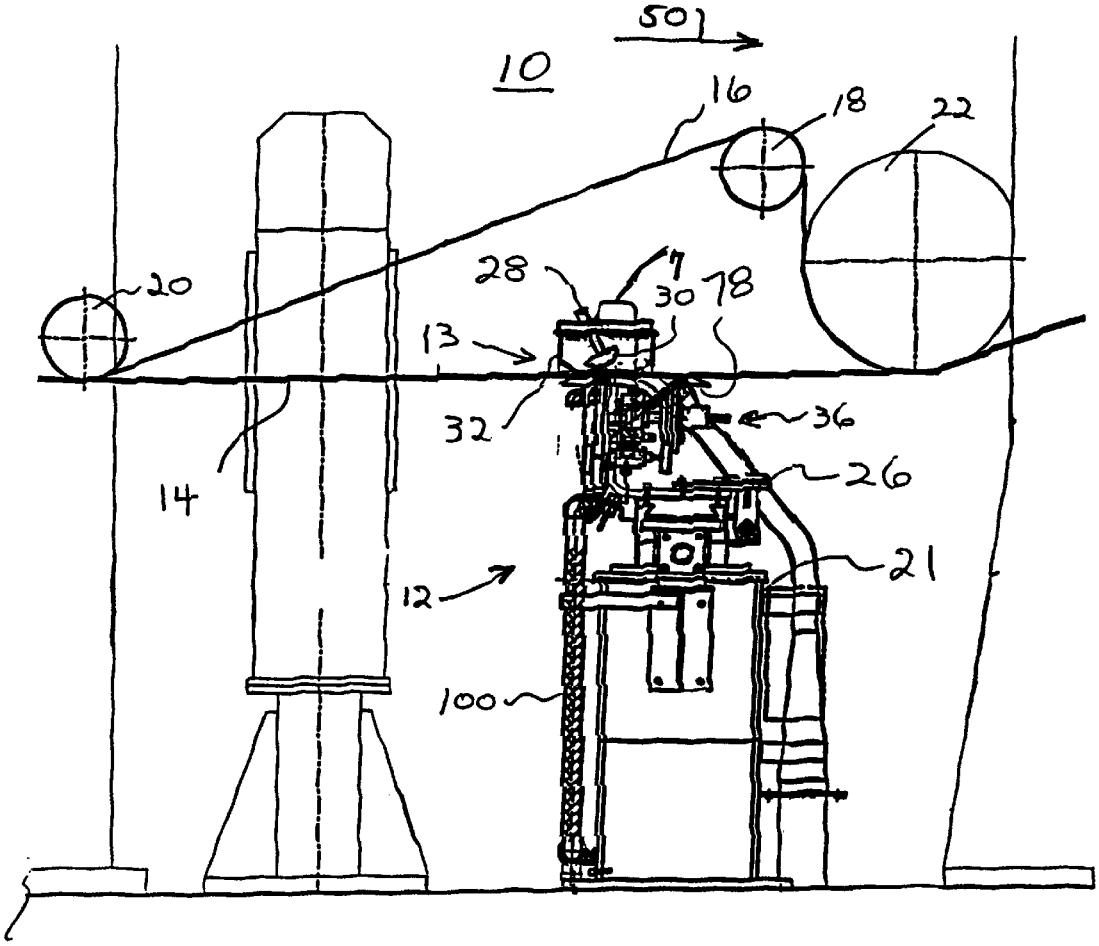
FIG. 1 is a side-elevation view of a portion of a coating section in a paper making machine showing the positioning of the trimming station downstream from the coating station.

Referring to FIG. 1 there is shown a coating section 10 of a paper making machine. A water jet edge trimming station or apparatus is shown generally at 12. It should be understood that the coating process occurs upstream of the trimming station 12. While the preferred application for the present invention is in the coating section of a paper making machine, the water jet trimming station 12 may be located in any portion of a papermaking machine that requires edge trimming. Furthermore, the present invention lends itself to applications where pronounced or large amounts of backsplash occur due to the water jet cutting through heavier grades of paper and/or coated paper.

In FIG. 1 the web or paper web 14 is shown passing through water jet trimming station 12. Typically, web 14 is threaded first by rope(s) 16. To permit access to the web 14 at the edge trimming station 12, a separator sheave 18 lifts the rope(s) 16 from the web 14 at first sheave 20. The ropes 16 pass over roller 22 and again meet the web 14.

The trimming station 12 is supported on a base 21 and a movable carriage 26. The movable carriage 26 moves back and forth in a direction across the width of the web 14 to allow an initial edge cut into the web 14 and subsequent slitting or edge trimming of the web 14. Carriage 26 carries the support table 78 for the cutting station 13.

Figure 3:
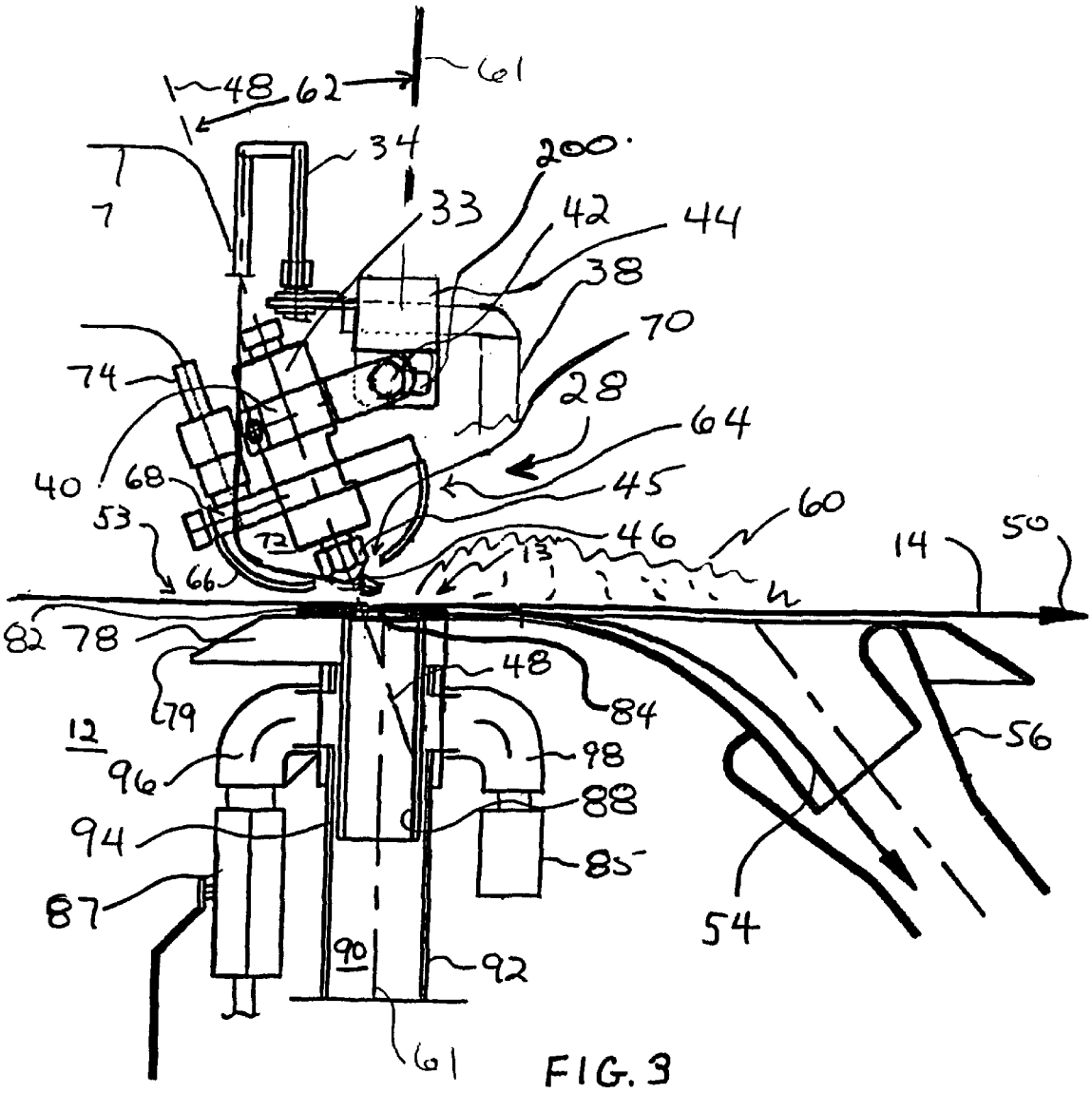
FIG. 3 is a side sectional view taken along section line III—III in FIG. 2, which section line extends along a line rotated about the normal axis and is bent at the point of impingement to extend along the cut edge of the paper, showing the cutting action of the water jet and the relative positioning of the cutting table below the surface of the web.

Above the web 14, the trimming station 12 includes a water jet cutter 28 having a mushroom shaped head 30. The water jet cutter 28 is supported above the web by an arm 38 (FIG. 3) connected to the carriage 26. An operator guard 32 is provided for safety covering the water jet 48, (FIG. 3). The water jet 48, (FIG. 3) is fed water from conduit 7. Conduit 7 is connected to a controlled valve generally shown at 36.

Figure 2:
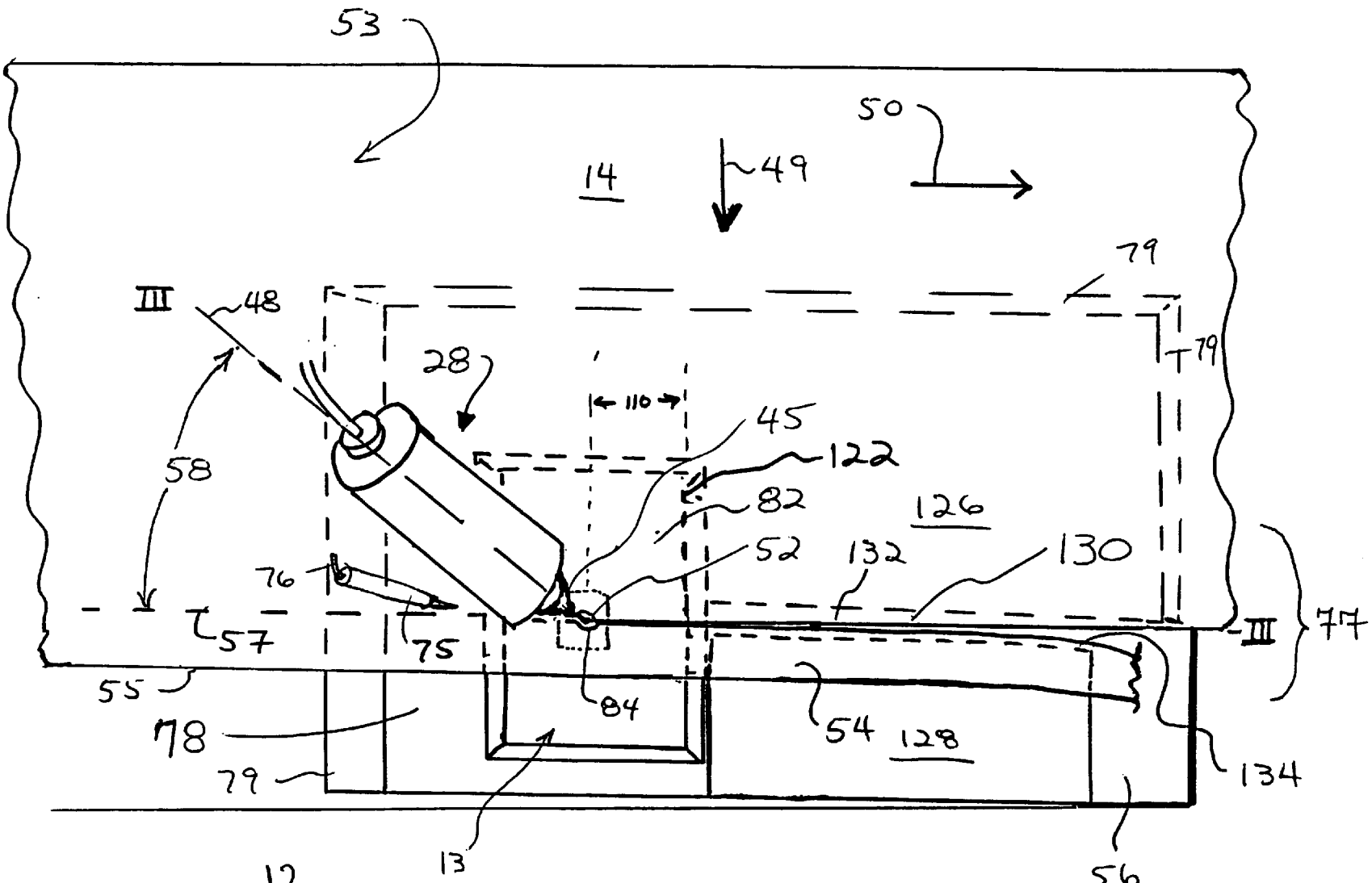
FIG. 2 is a plan view of the traveling web of paper showing the relative positioning of the water jet and cutting table to the traveling web.

In accordance with one aspect of the present invention the angulation of the water jet axis 48 to reduce backsplash is now described. While FIGS. 3 and 5 show the water jet axis 48 being oriented by a first predetermined angle 62 and FIG. 2 shows the water jet axis 48 being oriented by a second predetermined angle 58, FIG. 3 is the best illustration showing the means for obtaining the first, and in FIG. 2, for the second predetermined angles and FIG. 4 is the best illustration to describe the orientation of the water jet axis 48.

In FIG. 3, the water jet cutter 28 includes a water jet nozzle body 33 through which the conduit or water inlet 7 is connected. At the other end of water jet nozzle body 33 is connected a jet nozzle retaining nut 45. The jet nozzle retaining nut 45 has an outlet orifice 46 through which a laminar water jet is emitted along water jet axis 48. The means for obtaining the angle orientation of water jet axis comprises angular bracket 40 surrounding the nozzle body 33 and connected by adjustment screw 42 to pin 44. Pin 44 is pivotally connected to arm 38 to carriage support plate 36 of the trimming station 12. The pivot axis 44 allows adjustment of water jet axis 48 by the second predetermined angle. The pivot screw 42 allows the water jet cutter 28 to be secured in place at the first predetermined angle and also adjustable sideways by slot 200.

Figure 4:
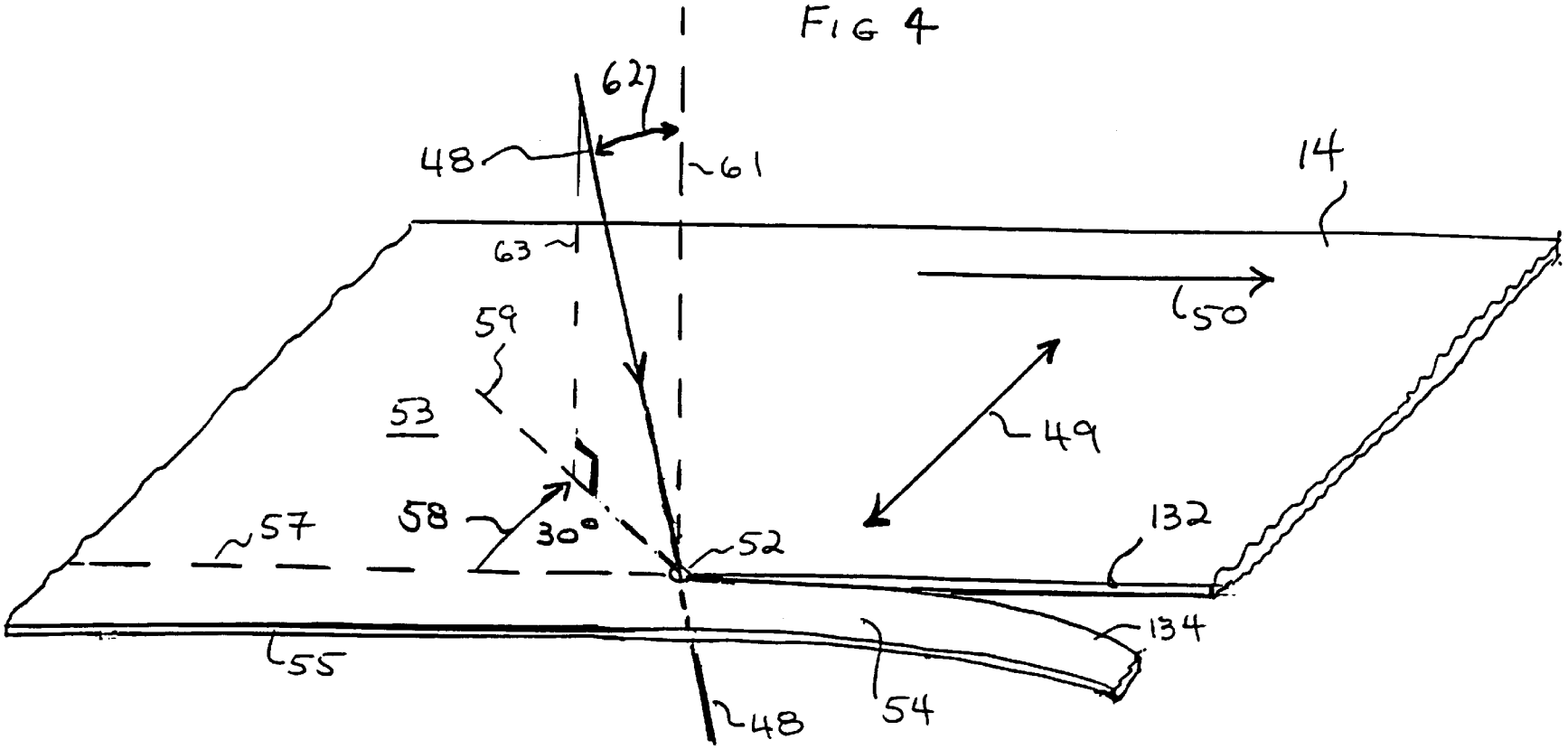
FIG. 4 is a three dimensional illustrative view of the water jet axis relative to the point of impingement on the paper web; and, FIG. 5 is an enlarged view of the cutting station and support table as shown in FIG. 3.
Figure 5:
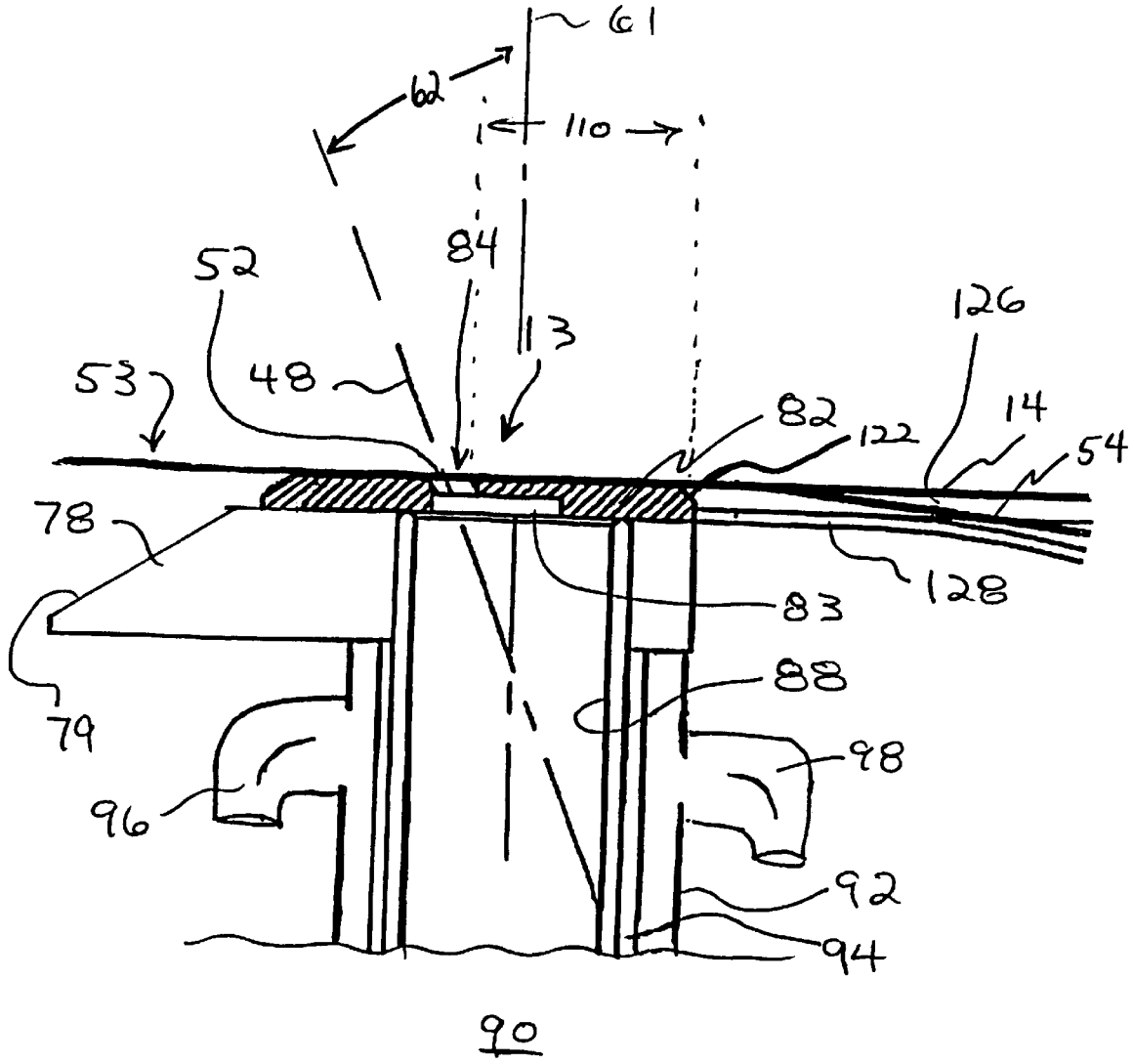
Figure 1:
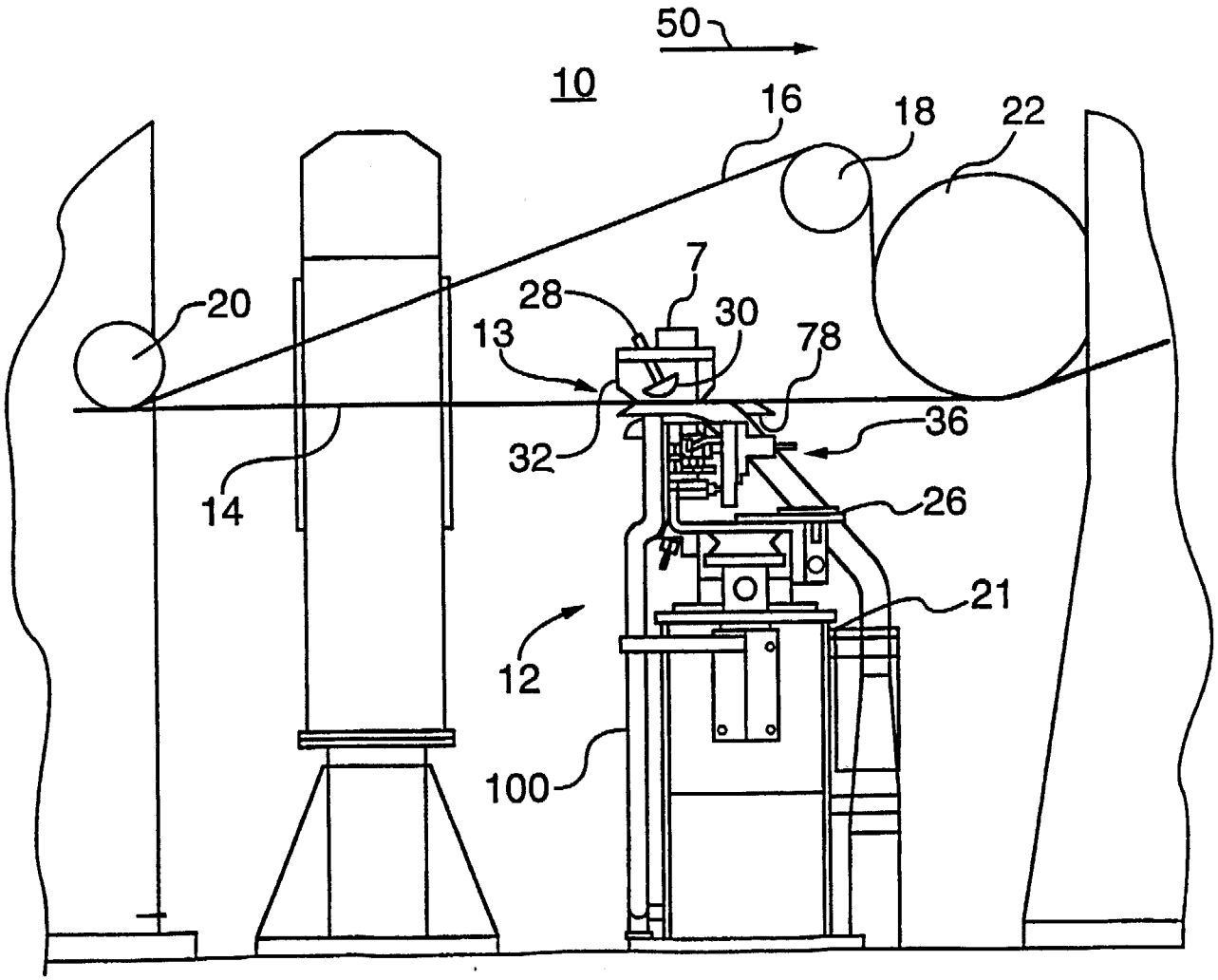
Figure 2:
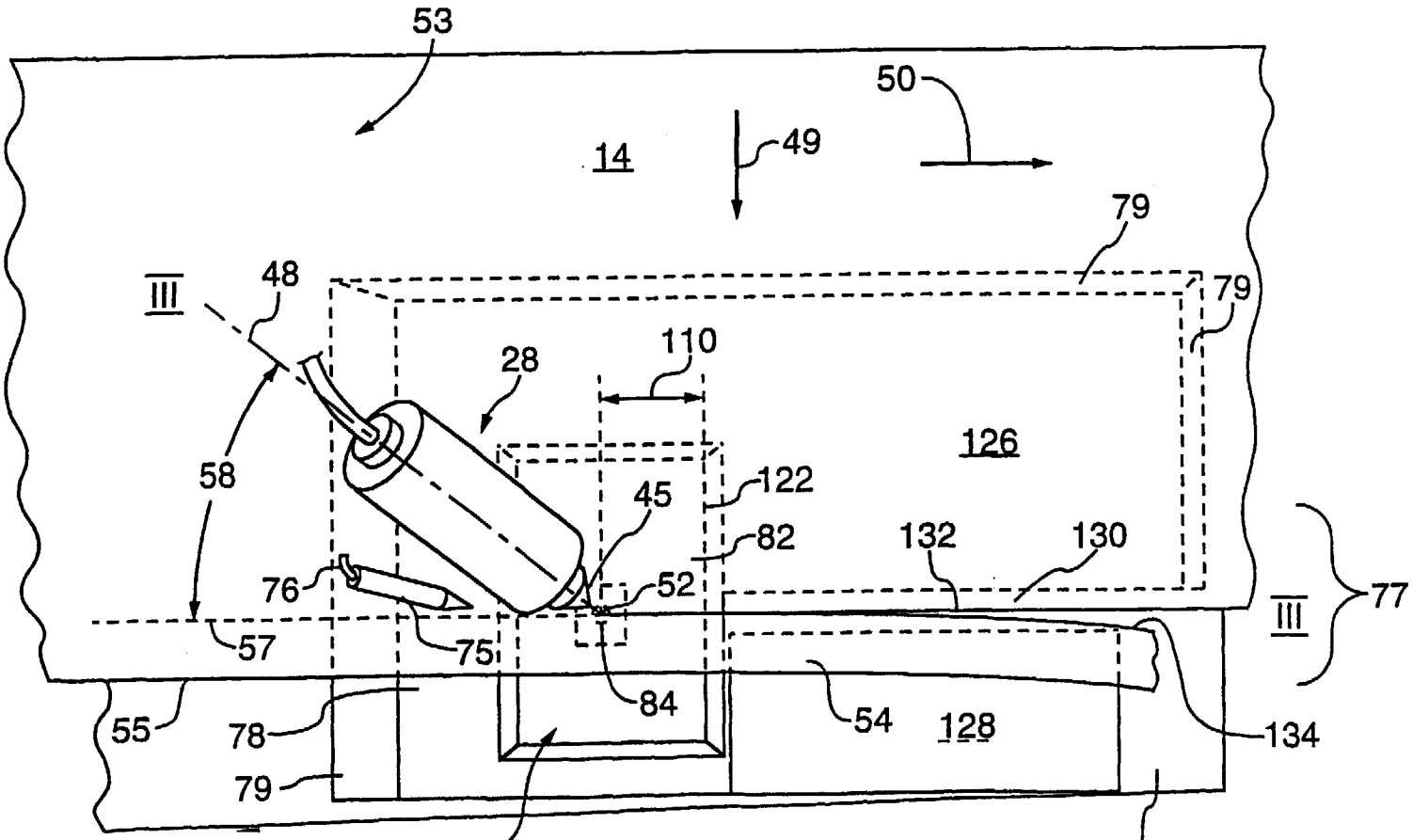
Figure 3:
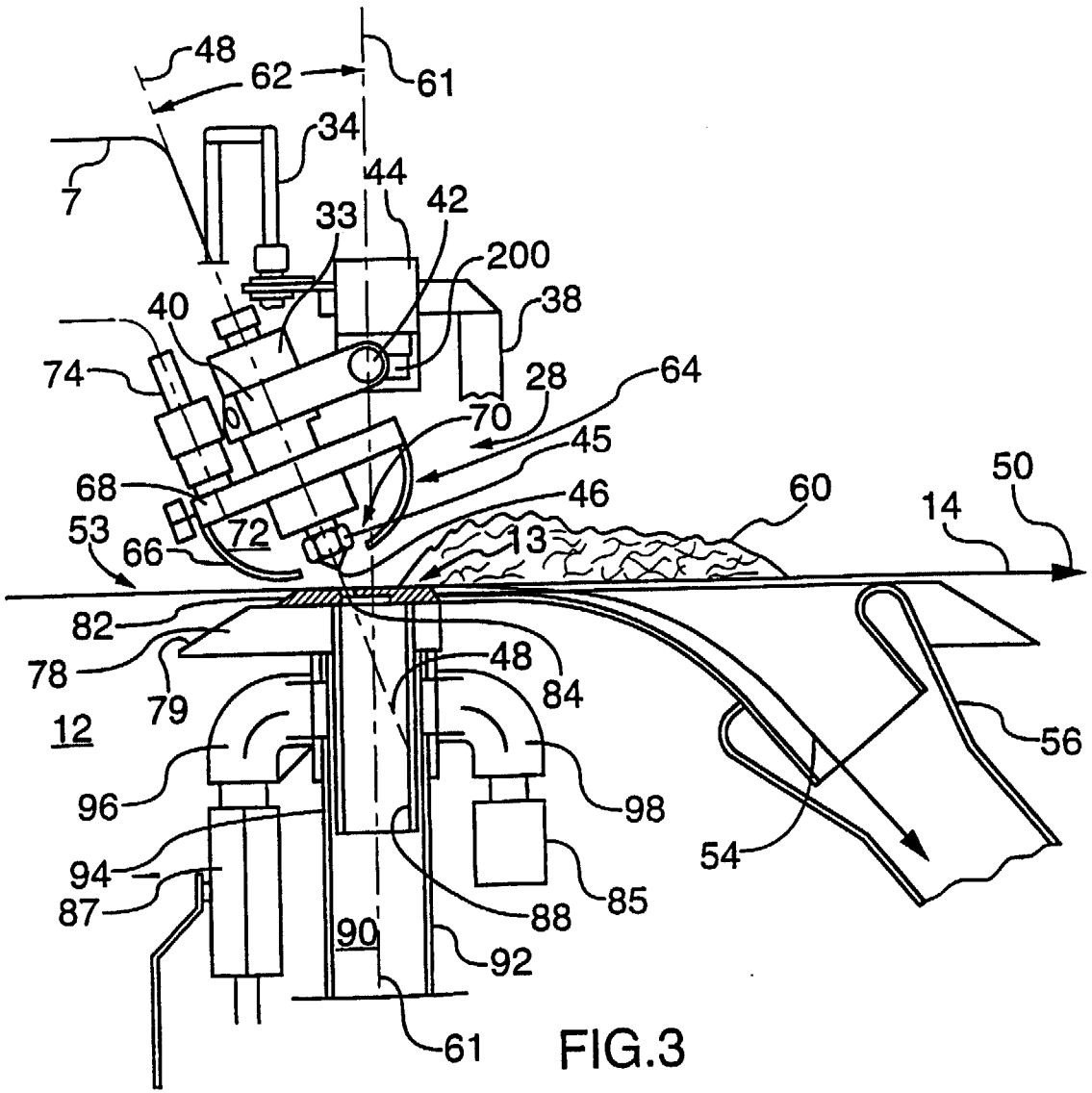
Figure 4:
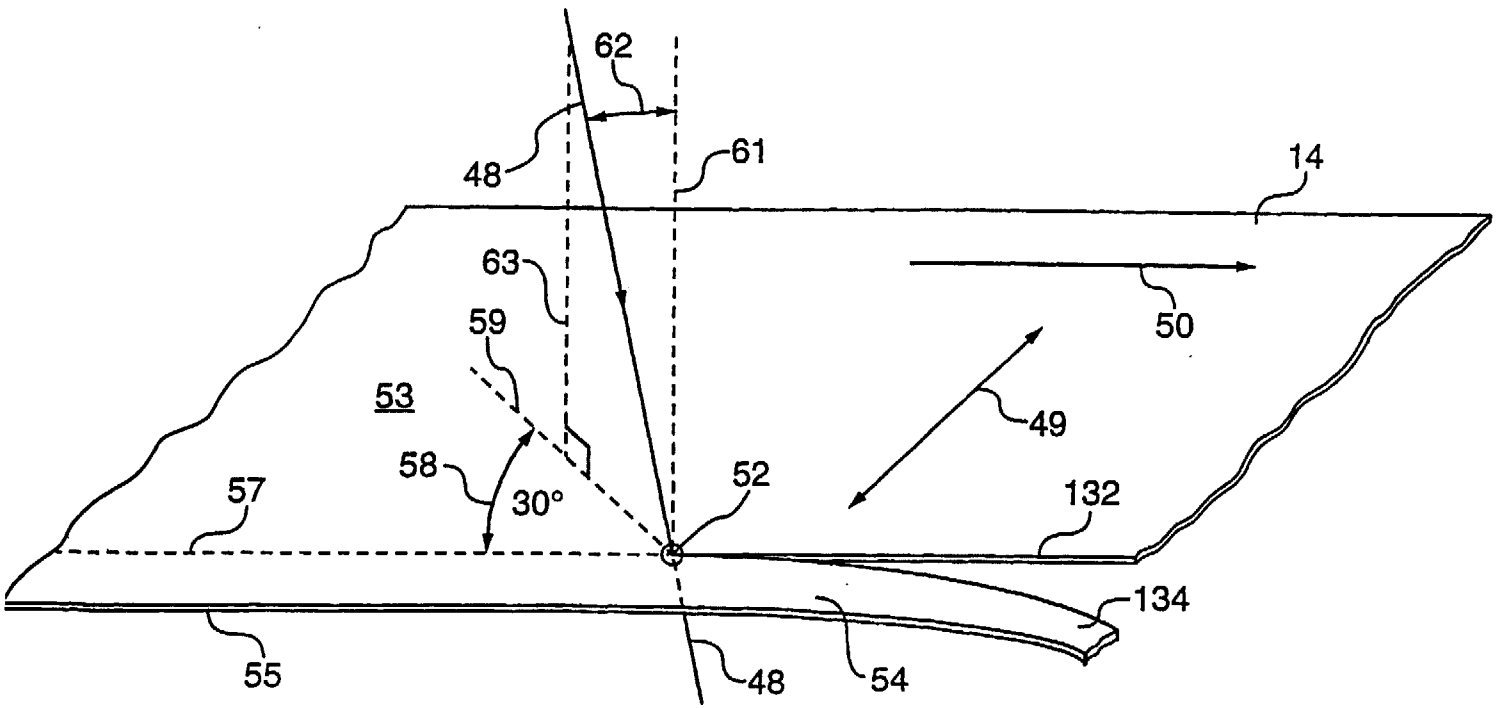
Figure 5:
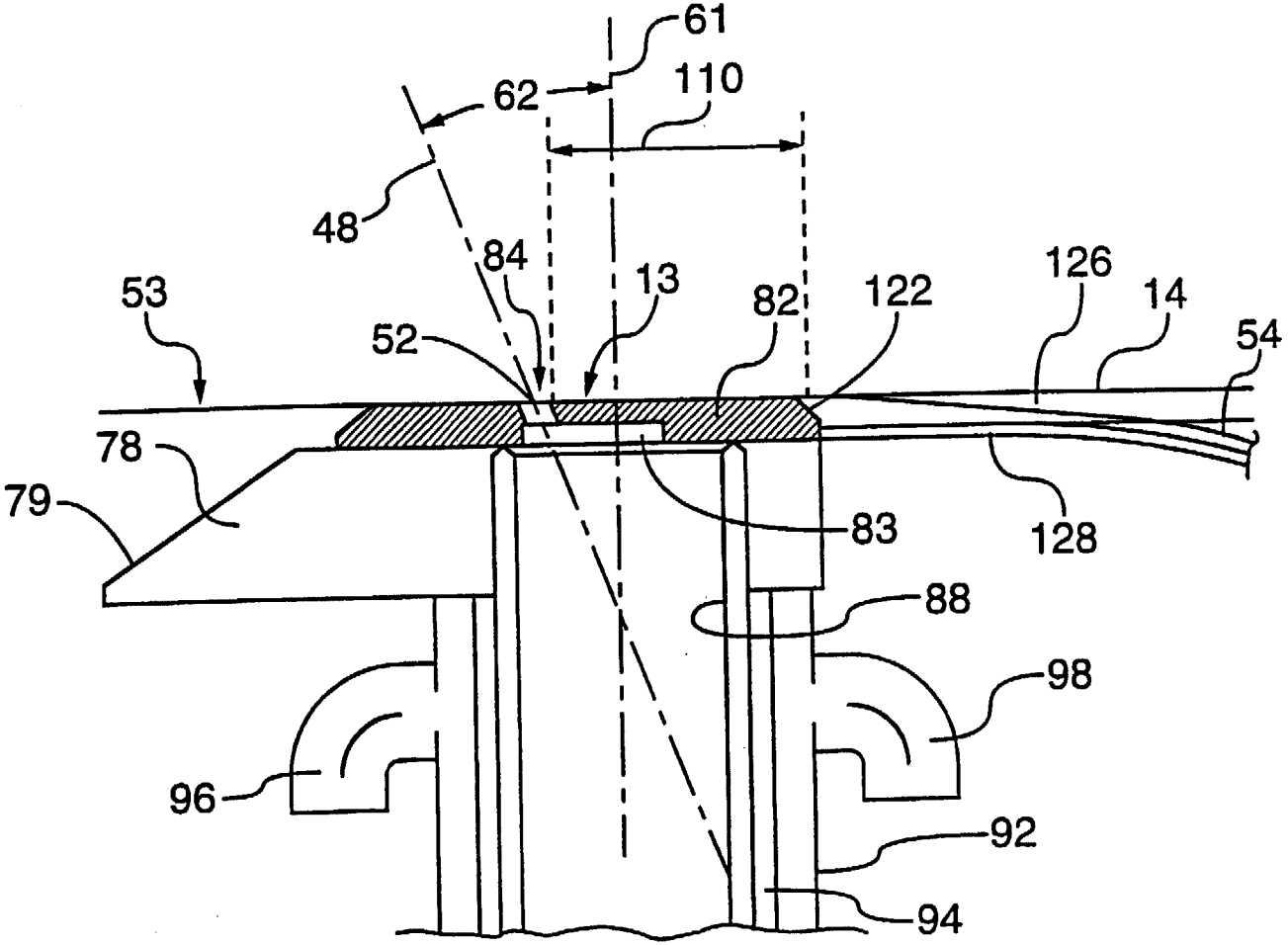

Referring to FIGS. 2 to 5, and particularly FIG. 4, the orientation of the water jet axis 48 is described relative to the first and second predetermined angles 62 and 58, respectively. The direction of web 14 travel is shown generally by arrow 50. The cross-direction of carriage travel is shown by arrow 49. The arrows 49 and 50 define a relatively flat web plane passing by the trimming station. The water jet axis 48 is directed at web 14 and cuts through web 14 at point of impingement 52. As the water jet cuts through the web it produces an edge trim piece 54 that is separated from the remainder of the web 14 continuing on its downstream travel of arrow 50. The edge trim piece 54 moves past trimming station 12 and into trim chute 56. The trim chute 56 is attached to the side of trimming station 12.

The orientation of the water jet axis 48 is shown angled by first predetermined angle 62 relative to normal axis 61. Normal axis 61 is defined as a line extending at a right angle out of the web plane through point of impingement 52. This normal axis may be referred to as a vertical axis when the web plane is running horizontally past the trimming station 12. In the preferred embodiment of FIG. 4, the first predetermined angle 62 is shown to be about 22°. This angle may vary between 5° and 45°. In FIG. 4 a broken line 57 extends parallel to the web travel 50 and edge of the web 55 upstream of the point of impingement 52. Broken line 57 is shown to pass through point of impingement 52 and lie on the web plane. The second predetermined angle 58 is shown to be rotated about normal axis 61 from line 57. The second predetermined angle may lie in the range of 5° to 135° and in the preferred embodiment shown is about 30°. This results in a generally downstream and cross-stream direction of angulation of water jet 48. For illustrative purposes, the angular rotation of water jet axis 48 about normal axis 61 on the web plane is shown by broken line 59. Also, for illustrative purposes broken line 63 extending parallel to axis 61 is shown.

By so orienting the water jet axis 48, backsplash associated with the water jet splashing back onto the water jet nozzle and web 14 continuing to travel along arrow 50 is reduced. Further, the fog 60 (FIG. 3) formed by effluent by-products of minute particles of paper and water during cutting are directed away from the nozzle 45 towards the edge trim piece 54, and trim evacuation chute 56.

Another aspect of the present invention relates to the construction of water jet cutter 28 as best shown in FIG. 3. In particular to protect the nozzle retaining nut or head 45 and orifice 46 from buildup of stalactite, the water jet is provided with a mushroom shaped head or cap shown generally at 64. The mushroom head 64 forms part of an enlarged nozzle head housing 66 attached with a base plate or flange 68 to the water jet nozzle body 33. Forward of the base plate 68 is provided the mushroom front surface 64. The curved surface 64 has an annular aperture spaced from the nozzle head 45 defining an air outlet passage 70. The base plate 68 and mushroom shaped front surface cover 64 together form a chamber 72. Pressurized air is communicated into chamber 72 through air inlet tubing 74. The pressurized air entering chamber 72 exits the chamber 72 at air outlet passage 70 around the nozzle head 45 causing a positive air flow pressure away from the outlet orifice 46 of the water jet 48. This positive air flow pushes potential effluent by-products away from the waterjet orifice 46 and nozzle head 45. Also located upstream and laterally of the water jet apparatus 28 is an additional air nozzle 75 (FIG. 2). Air nozzle 75 is connected to air supply 34 to blow additional air beside or across the cutting point of impingement 52 to move fog 60 downstream and away from the stream from the water jet orifice 46. Further, nozzle 75 directs the edge trim 54 immediately following the cut at the point of impingement 52 into the trim chute 56.

The waterjet 48 maintains a laminar flow to cut through the paper web 14. In particular, when a flying splice passes beneath the water jet cutting apparatus, this portion of the web may have three times the basis weight of the web 14 normally passing beneath the cutting jet. To ensure that a cut is maintained, the nozzle head of the water jet 48 is maintained at the predetermined distance above the web 14 to maintain the laminar flow of the water jet. In accordance with the present invention, the outlet orifice 45 of the water jet cutter 28 is maintained about 12 mm from the web surface. As this is not a large distance and the effects of backsplash would result in limited operation of the water jet cutter 28 prior to cleaning if it were not for the features taught by the present invention. Furthermore, within the operating environment of the water jet trimmer, the nozzle orifice has a diameter in the range of 0.07 to 0.153 mm. Also, the water jet has pressures in the order of 16,000 to 35,000 PSIG. This results in the waterjet hitting surface of the paper at speeds in excess of 615 meters/second.

Another aspect to the present invention relates to the trimming station 12 as shown below the web 14 in FIGS. 2, 3 and 5. The trimming station 12 includes a support table 78 over which at least an edge portion 77 of the web 14 travels. The portion of the trimming station 12 located below the web 14 performs a novel function in waterjet cutting. The purpose of the trimming station 12 below the web 14 is to evacuate effluent by-products downwardly away from the point of cutting impingement 52. To accomplish this the trimming station 12 further includes a cutting station 13 mounted on a support table 78. The cutting station 13 has a hardened cutting surface 82. The surface 82 comprises a ceramic shoe mounted raised above the cutting station 13 of support table 78. It is also apparent from the drawings that the cutting station 13 has beveled or sloped edge 79. Sloped edge 79 allows the paper web 14 to run up over the support table 78. The ceramic surface 82 also has bevelled edges and is sufficiently hard to better withstand cutting and wear associated with the waterjet cutting and abrasiveness of coated paper.

The ceramic shoe 82 includes an effluent receiving aperture 84. The ceramic shoe has an undercut or cut out 83 (FIG. 5) below the aperture 84 to minimize the amount of land area the jet is striking within the aperture. Because the effluent by-products contained in the waterjet have adhesive characteristics, the smaller the depth of the aperture 84 the less build-up of residues can occur in the aperture resulting in exhausting of the effluent by-products below the web. At the same time the wear resistance of the shoe must be maintained. In the preferred embodiment, it has been found that the depth of this aperture should be in the order of 2 to 4 mm. The axis of the effluent receiving aperture 84 is preferably in alignment with the waterjet axis 48. It should be understood that the aperture could be cone shaped with a conical wall of the aperture lying parallel to the waterjet axis 48.

The cutting station 13 further includes a draft tube 88 connected in fluid flow communication with the effluent receiving aperture 84. The draft tube 88 extends approximately 75 to 100 mm into a mixing zone 90. The preferred extension of the draft tube is about 100 mm. The mixing zone 90 is connected to exhaust or a negative pressure apparatus 100(FIG. 1). Pipe 92 surrounds the draft tube 88 and is spaced from the draft tube 88. An outer passage 94 is located between the pipe 92 and the draft tube 88. Pipe 92 has an air inlet 98 and a water inlet 96. An air control valve 85 controls the volume of air drawn from the environment. Water valve 87 controls flow of water into inlet 96; together the valves 85 and 87 control negative pressure or vacuum in the mixing zone 90. Due to the negative pressure, the water entering through water inlet 96, and air entering through inlet 98 cause the effluent by-products to be drawn through aperture 84 to be mixed in the mixing zone 90. This allows for a dilution of the effluents to facilitate removal from the cutting station. The mixing zone 90 is connected to exhaust 100(FIG. 1)

By drawing effluent by-products into the cutting station, the present invention diminishes the amount of fog or potential backsplash which would otherwise remain below web 14 and cutting table 78 and could result in uneven buildup of by-products effecting function of the edge trimmer.

The aperture 84 at point of impingement 52 is located a distance 110 upstream from the downstream end 122 of the cutting station 13. This distance 110 is about 40 mm. By maintaining this distance relatively short below 50 mm, there is an insufficient surface length over which the web 14 and trim piece 54 travel thereby minimizing the surface area over which gummy deposits of effluent by-products can buildup creating a ridge of hardened material that can adversely effect the cutting performance of the water jet station. This buildup is the result of effluent by-products or backsplash that remains below the surface of web 14 and are not drawn into aperture 84.

The cutting station 13 in addition to the raised ceramic shoe 82 includes a first raised platform 126 extending downstream of the cutting station 13. The station 13 further includes a lower initially or stepped down second platform 128. The platforms 126 and 128 are at the same height close to the ceramic shoe 82. Platform 128 curves and is offset below platform 126 in the direction of web travel. Platforms 126 and 128 are separated by an elongated slotted aperture 130. The purpose of the platform 126 is to temporarily support the traveling web 14 and the purpose of the second platform 128 is to temporarily support the edge trim piece 54 prior to disposal in the trim chute 56. The raising of the first platform 126 relative to the second platform 128 provides for better separation of the edge trim piece 54 from the coated web 14. The elongated slotted aperture 130 provides an open space between the platforms 126 and 128 over which the wet edges 132 and 134, respectively, of the cut web 14 and edge trim piece 54 are allowed to dry so that effluent by-products do not build up on a surface effecting paper quality and the trimming operation.

While the foregoing description has been made in reference to the drawings and an "on-machine" coating section of a papermaking machine, it should be understood that various aspects of the present invention may find application in other parts of papermaking machines as would be readily apparent to a man skilled in the art.

What is claimed is:

1. A water jet edge trimming station for trimming an edge of a traveling paper web in a papermaking machine, comprising:

a water jet apparatus supported above said web for directing a water jet towards a point of impingement against said web to cut through said web and form an edge trim piece separate from said web, and said water jet forming effluent by-products as it cuts said web;

a support table positioned below said water jet and over which at least an edge portion of said web travels, said support table including a cutting station;

said cutting station including a cutting surface for withstanding cutting and wear associated with the paper striking said cutting surface, said cutting station including an effluent receiving aperture extending from the cutting surface through the cutting station and positioned directly below the point of impingement of said water jet through which passes said water jet after cutting through said web, a negative pressure apparatus mounted directly below the cutting station and surrounding the effluent receiving aperture adapted to draw said water jet and said effluent by-products through said receiving aperture to reduce backsplash of effluent by-products; and, a trim removal chute separate and distinct from said negative pressure apparatus, said trim removal chute being positioned adjacent and downstream of said support table for guiding said edge trim piece away from the web.

2. The water jet edge trimming station of claim 1 wherein said support table includes a ceramic shoe having said hardened cutting surface and said effluent receiving aperture.

3. The water jet edge trimming station of claim 2 wherein said cutting station includes a draft tube extending from the effluent receiving aperture into the cutting station.

4. The water jet edge trimming station of claim 3 wherein said negative pressure apparatus comprises a vacuum pump in air flow communication with said draft tube.

5. The water jet edge trimming station of claim 3 wherein said cutting station includes a chamber into which said draft tube partially extends to define an outer passage surrounding the draft tube, said chamber including a water inlet and an air inlet adjacent the hardened cutting surface which permit the introduction of water and air into the an outer passage surrounding the draft tube and extending into the cutting station, said cutting station further including a mixing zone located below the draft tube and the outer passage for mixing the air and water from the outer passage and effluent by-products from said draft tube.

6. The water jet edge trimming station of claim 5 wherein said negative pressure apparatus includes a vacuum pump connected to the lower end of said mixing station to assist in evacuating waste from said mixing zone through an outlet pipe.

7. The water jet edge trimming station of claim 2 wherein said cutting surface includes a land cut out below the cutting surface adjacent the effluent receiving aperture to control the predetermined depth.

8. The water jet edge trimming station of claim 1 wherein the cutting station includes a draft tube extending from the effluent receiving aperture into a mixing zone, the cutting station including a pipe surrounding the draft tube to provide an outer passage surrounding said draft tube, said pipe including an air inlet and a water inlet, said negative pressure apparatus including valve controllers associated with each of the air and water inlets which regulate flow of the air and water along an outside surface of said draft tube and into said mixing zone to produce a negative pressure in said draft tube, the air and water flowing into the mixing zone mixing with the effluent by-products from the draft tube to provide a waste that can be evacuated from said mixing zone.

9. The water jet edge trimming station of claim 1 wherein the water jet is angled relative to an axis extending through the point of impingement and normal to a plane of the web.

10. The water jet edge trimming station of claim 9 wherein the water jet is further angled towards the outside edge of the traveling web.

11. The water jet edge trimming station of claim 10 wherein the effluent receiving aperture has an axis aligned with an axis along which the water jet is emitted.

12. The water jet edge trimming station of claim 1 wherein the web of paper is coated prior to entering the trimming station.

13. The water jet edge trimming station of claim 1 wherein the effluent receiving aperture is located a predetermined distance upstream of a downstream end of the cutting station to reduce buildup of effluent by-products on the hardened surface of the cutting station downstream of the effluent receiving aperture.

14. The water jet edge trimming station of claim 13 wherein said predetermined distance is in the range of 5 to 50 mm.

15. The water jet edge trimming station of claim 1 wherein said effluent receiving aperture has a predetermined depth permitting an effective vacuum to be drawn through said effluent receiving aperture to effectively accept effluent by-products through the aperture diminishing the volume of effluent by-products available for backsplash.

16. The water jet edge trimming station of claim 15 wherein said predetermined depth is between about 2 to 4 mm.

17. The water jet edge trimming station of claim 1 wherein said support table includes an elongated slotted aperture extending from the cutting station in the downstream direction of travel of said web over which edges of the web and the edge trim piece travel unsupported.

18. The water jet edge trimming station of claim 17 wherein said support table includes a first platform extending around and downstream from the cutting station for supporting the traveling web and a second platform extending downstream from said cutting station, said second platform starting at the same height as the first platform and curving downwardly below the first platform in the direction of web travel, said second platform supporting said edge trim piece separated from said web, and said first platform being raised and laterally separated from said second platform by said elongated slotted aperture.

19. The water jet edge trimming station of claim 17 wherein said hardened material of said cutting station is supported in a raised manner above said support table, said support table includes a first platform extending downstream from the cutting station below the raised hardened material for supporting the traveling web and a second platform extending downstream from said cutting station and positioned lower than the first platform, said second platform supporting said edge trim piece separated from said web, and said first platform being raised and laterally separated from said second platform by said elongated slotted aperture.

20. A water jet edge trimming station for trimming an edge of a traveling paper web in a papermaking machine, comprising:

a water jet supported above a substantially flat traveling surface of said web for directing a water jet through a nozzle along a water jet axis towards a point of impingement against said web to cut through said web and form an edge trim piece separate from said web, said water jet forming effluent by-products as the water jet cuts said web; said water jet axis having a first predetermined angle chosen relative to a normal axis passing at a right angle through the point of impingement of said web in the range of 5° to 45° to reduce backsplash of effluent by-products onto said nozzle, and said water jet having a second predetermined angle chosen rotated about said normal axis in the range of 5° to 135° to direct effluent by-products away from the nozzle and traveling web and towards said edge trim piece;

a support table positioned below said water jet and over which at least an edge portion of said web travels, said support table including a cutting station; and, said cutting station including a cutting surface for withstanding cutting and wear associated with the paper striking said cutting surface, said cutting station including an effluent receiving aperture extending from the cutting surface through the cutting station and positioned directly below the point of impingement of said water jet through which passes said water jet after cutting through said web;

said cutting station including a negative pressure apparatus mounted directly below the cutting station and surrounding the effluent receiving aperture adapted to draw said water jet and said effluent by-products through said receiving aperture to reduce backsplash of effluent by-products; and, a trim removal chute separate and distinct from said negative pressure apparatus, said trim removal chute being positioned adjacent and downstream of said support table for guiding said edge trim piece away from the web.

21. The water jet edge trimming station of claim 20 wherein the first predetermined angle is about 22° and the second predetermined angle is about 30°.

22. The water jet edge trimming station of claim 20 wherein said support table includes a ceramic shoe having said hardened cutting surface and said effluent receiving aperture.

23. The water jet edge trimming station of claim 20 wherein the cutting station includes a draft tube extending from the effluent receiving aperture into a mixing zone, the cutting station including a pipe surrounding the draft tube to provide an outer passage surrounding said draft tube, said pipe including an air inlet and a water inlet, said negative pressure apparatus including valve controllers associated with each of said air and water inlets which regulate flow of air and water along an outside surface of said draft tube and into said mixing zone to produce a negative pressure in said draft tube, and the air and water flowing into the mixing zone mixing with the effluent by-products from the draft tube to mix with the air and water to provide a waste that can be evacuated from said mixing zone.

24. The water jet edge trimming station of claim 20 wherein the nozzle is maintained within a predetermined distance from the traveling web to maintain a laminar jet of water to cut said web.

25. The water jet edge trimming station of claim 20 wherein said predetermined distance is about 12 mm from said web.

* * * * *

UNITED STATES PATENT AND TRADEMARK OFFICE

CERTIFICATE OF CORRECTION

PATENT NO. : 6,001,219
DATED : December 14, 1999
INVENTOR(S) : Caspar

It is certified that error appears in the above-identified patent and that said Letters Patent is hereby corrected as shown below:

Title page,
The illustrative figure should be deleted and substitute therefor the attached title page.

In the drawings,
Replace Figures 1 to 5 with drawings attached.

Column 11,
Line 3 (claim 2, line 3), delete "hardened".

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

United States Patent [19]

Caspar

[11] Patent Number: 6,001,219

[45] Date of Patent: Dec. 14, 1999

[54] WATER JET EDGE TRIMMING STATION FOR USE IN PAPERMAKING MACHINE

[76] Inventor: Roman C. Caspar, 21 Margaret Ann, Beaconsfield, Quebec, Canada, H9W 5N7

[21] Appl. No.: 08/852,345

[22] Filed: May 7, 1997

[51] Int. Cl.[6] ..... B26D 5/12

[52] U.S. Cl. ..... 162/286; 162/310; 162/363; 83/177; 83/402

[58] Field of Search ..... 162/286, 194, 162/310, 363, 364, 195, 198; 83/177, 402, 53, 428

[56] References Cited

U.S. PATENT DOCUMENTS

| | | | |
|---|---|---|---|
| 2,667,106 | 1/1954 | Hyman et al. | 162/255 |
| 3,532,014 | 10/1970 | Franz | 83/53 |
| 3,556,936 | 1/1971 | Miyamoto | 162/272 |
| 3,682,750 | 8/1972 | Gerber | 156/545 |
| 3,927,591 | 12/1975 | Gerber | 161/68 |
| 3,996,825 | 12/1976 | Terry | 83/53 |
| 4,137,804 | 2/1979 | Gerber et al. | 83/177 |
| 4,182,170 | 1/1980 | Grupp | 73/177 |
| 4,266,112 | 5/1981 | Niedermeyer | 83/53 |
| 4,410,315 | 10/1983 | Frye | 493/342 |
| 4,567,796 | 2/1986 | Kloehn et al. | 83/53 |
| 4,827,679 | 5/1989 | Earle, III | 51/410 |
| 4,882,961 | 11/1989 | Zabinski et al. | 83/177 |
| 4,931,140 | 6/1990 | Pelkola et al. | 162/193 |
| 5,068,513 | 11/1991 | Gangemi | 219/121.67 |
| 5,295,425 | 3/1994 | Hediger | 83/177 |
| 5,512,136 | 4/1996 | Altug et al. | 162/195 |
| 5,571,381 | 11/1996 | Vessari et al. | 162/195 |

FOREIGN PATENT DOCUMENTS

| | | |
|---|---|---|
| 772459 | 11/1967 | Canada . |
| 772461 | 11/1967 | Canada . |
| 3219564 | 12/1983 | Germany . |
| 4218272 | 10/1992 | Germany . |

*Primary Examiner*—Stanley S. Silverman
*Assistant Examiner*—Jose' A. Fortuna

[57] ABSTRACT

A water jet edge trimming station for trimming the edges of coated paper during on-machine operation includes backsplash compensating features. The edge trimming station has a cutting station over which the web travels to be cut. The water jet travels along a water jet axis to a point of impingement at the cutting station to cut the web. The cutting station has an effluent receiving aperture at the point of impingement. A negative pressure mixing zone located below the aperture draws effluent by-products or backsplash associated with cutting of the web below the cutting surface of the web. The water jet axis is offset a first predetermined angle chosen relative to a normal axis passing at right angles through the point of impingement to reduce backsplash. The water axis jet is rotated about the normal axis by a second predetermined angle to direct the effluent by-products away from the water jet nozzle and the traveling web. The water jet cutting apparatus has positive air pressure chamber surrounding the nozzle head of the water jet to maintain an air flow over the nozzle head driving effluent backsplash away from the nozzle head.

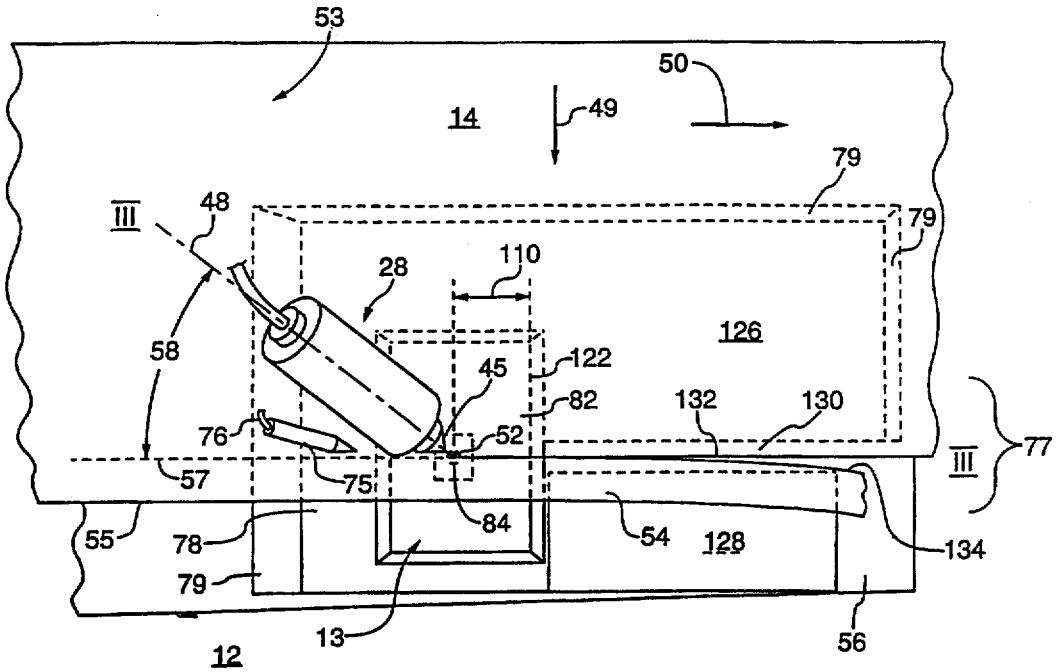

25 Claims, 5 Drawing Sheets